United States Patent [19]

Poulain et al.

[11] Patent Number: 4,953,355

[45] Date of Patent: Sep. 4, 1990

[54] STEAM TURBINE INSTALLATION WITH ADJUSTED BLEEDING

[75] Inventors: Jean Poulain, Lamorlaye; Jacques Desdouits, Chaville, both of France

[73] Assignee: GEC Alsthom SA, Paris, France

[21] Appl. No.: 393,209

[22] Filed: Aug. 14, 1989

[30] Foreign Application Priority Data

Aug. 16, 1988 [FR] France ..... 88 10921

[51] Int. Cl.[5] ..... F01K 13/02

[52] U.S. Cl. ..... 60/663; 60/677; 60/678; 60/715

[58] Field of Search ..... 60/663, 677, 678, 715

[56] References Cited

U.S. PATENT DOCUMENTS 1,777,470 10/1930 Marsland .
3,724,214 4/1973 Bryant .
4,087,797 5/1978 Wyler .
4,324,103 4/1982 Bloch ..... 60/663

FOREIGN PATENT DOCUMENTS 195326 9/1986 European Pat. Off. .
2061555 5/1981 United Kingdom .

OTHER PUBLICATIONS

Patent Abstracts of Japan, vol. 9, No. 22, 1/30/1985; JP-A-59, 168-203 (Mitsubishi Jukogyo).
Patent Abstracts of Japan, vol. 8, No. 148, 11/1984; JP-A-59 46-303 (Tokyo Shibaura Denki K.K.).

*Primary Examiner*—Allen M. Ostrager
*Attorney, Agent, or Firm*—Sughrue, Mion, Zinn, Macpeak & Seas

[57] ABSTRACT

A steam turbine installation with bleeding adjusted to a predetermined pressure P, the installation driving a load and including a bleed outlet disposed between two successive stages, wherein the bleed pressure P is adjusted over a range D of bleed rates by a servo valve disposed on the exhaust duct and controlled by a servo-control circuit including device for measuring the pressure of the bleed flow.

3 Claims, 2 Drawing Sheets

STEAM TURBINE INSTALLATION WITH ADJUSTED BLEEDING

The present invention relates to a steam turbine installation in which bleeding is adjusted to a determined pressure.

BACKGROUND OF THE INVENTION

Establishments having their own installation for producing electricity also desire to have steam at a determined pressure for use either for heating purpoes, or else for some industrial process.

In conventional turbine installations between bearings and having a large number of stages on a common shaft and in a single turbine, bleeding is performed as shown in the diagram of FIG. 1. Taking this figure as an example, it can be seen that bleeding takes place via an outlet S situated between the sixth stage P and the seventh stage Q, and that the adjusting valve R for maintaining the bleeding pressure constant is likewise situated between the sixth stage and the seventh stage.

This disposition is bulky and lengthens the turbine by a length equivalent to at least three stages, as can be seen in FIG. 1.

In addition, such a disposition is very rarely possible on a cantilevered multiple turbine installation.

SUMMARY OF THE INVENTION

The present invention thus provides a steam turbine installation with bleeding adjusted to a predetermined pressure P, the installation driving a load and including a bleed outlet disposed between two successive stages, wherein the bleed pressure P is adjusted over a range D of bleed rates by means of a servo valve disposed on the exhaust duct and controlled by a servo-control circuit including means for measuring the pressure of the bleed flow.

Advantageously, the turbine installation comprises two distinct turbines, with the bleed outlet being disposed between two successive stages of the first turbine and with the servo valve being disposed on the exhaust duct from said first turbine.

BRIEF DESCRIPTION OF THE DRAWINGS

Two embodiments of the invention are described by way of example with reference to the accompanying drawings, in which.

DETAILED DESCRIPTION

Figure 1:
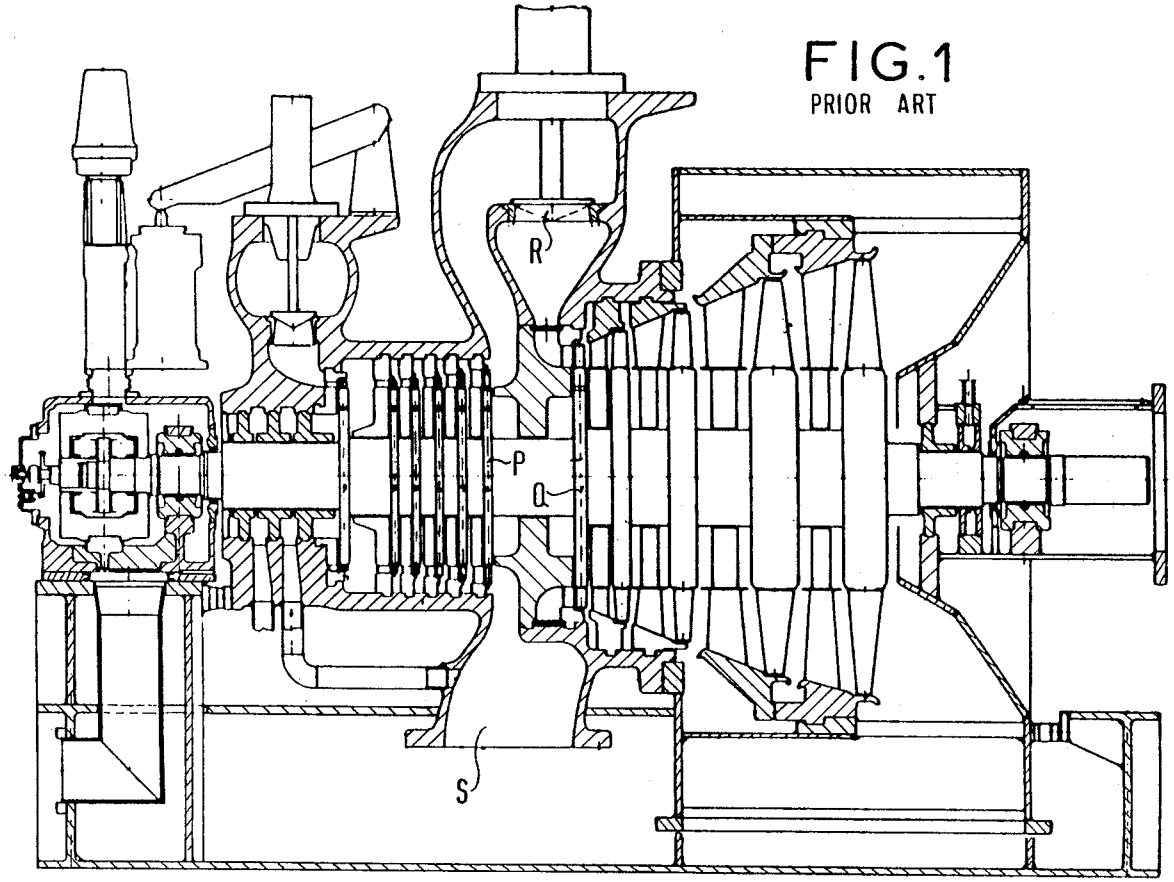
FIG.1 PRIOR ART
FIG. 1 shows a conventional steam turbine installation between bearings and driving an alternator, with bleeding taking place at an adjusted pressure in the conventional manner.
Figure 2:
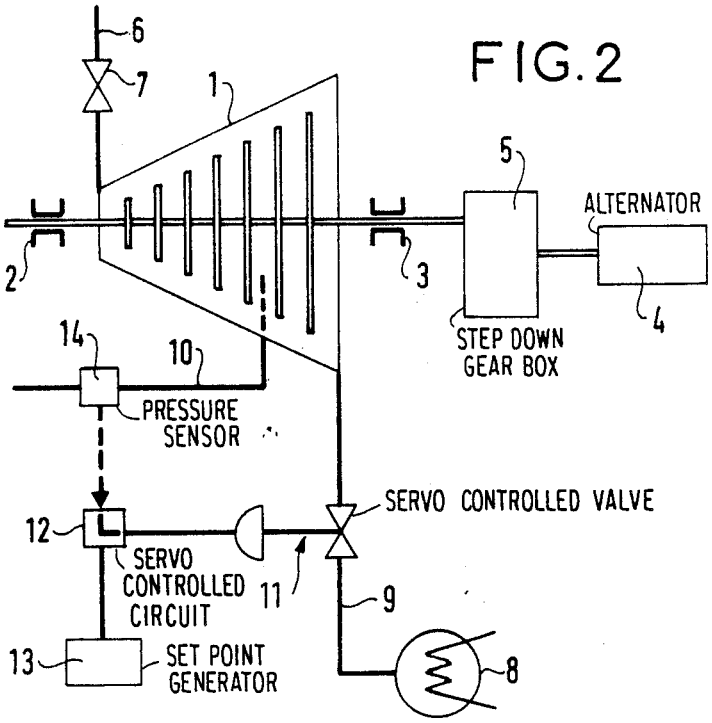
FIG. 2 is a schematic hydraulic diagram of a steam turbine installation between bearings in accordance with the invention.

With reference to FIG. 2, the installation shown comprises a steam turbine 1 mounted between two bearings 2 and 3. The turbine drives an alternator 4 via a stepdown gear box 5. A duct 6 including an admission valve 7 supplies steam to the turbine, and its exhaust is connected to a condenser 8 via a duct 9.

In the figure shown, the turbine has seven stages, and a bleed duct 10 runs fron an intermediate point in the turbine between its fifth stage and its sixth stage.

Bleeding is adjusted to a predetermined pressure P. In order to perform this adjustment over a given range D of bleed rates, the exhaust duct 9 is provided with a servo-controlled valve 11. This valve 11 is controlled by a servo-control circuit 12 including means for comparing a reference signal delivered by a set point generator 13 and a signal coming from a pressure sensor 14 situated in the bleed duct 10.

As can be seen, the invention makes it possible to physically separate the functions of bleeding and of adjusting the bleed pressure, thereby reducing the length of the turbine rotor.

Figure 3:
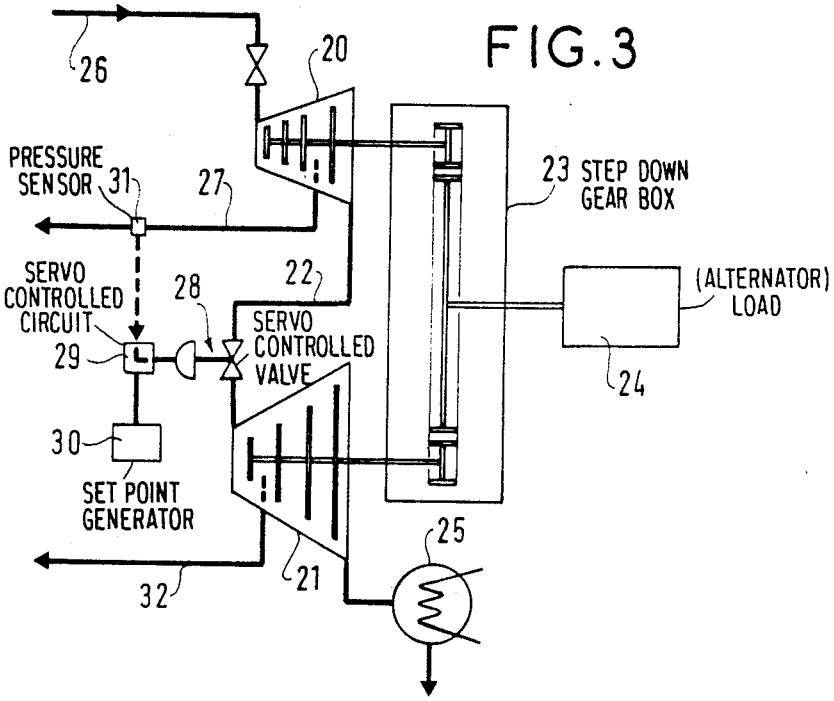
FIG. 3 is a schematic hydraulic diagram of a preferred steam turbine installation in accordance with the invention comprising two turbines in a cantilevered configuration.

FIG. 3 shows a particularly advantageous example of the invention as applied to a cantilevered multiple turbine installation. In FIG. 3, the installation shown comprises two steam turbines 20 and 21 which are cantilvered. The high pressure turbine 20 is connected to the low pressure turbine 21 by means of the high pressure turbine exhaust duct 22. The two turbines 21 and 22 are connected in parallel to inlets of a stepdown gear box 23 whose outlet shaft drives a load 24, e.g. an alternator. The low pressure turbine 21 exhausts into a condenser 25.

The high pressure turbine 20 is fed with steam from an admission duct 26 which is provided with an admission valve 33, with said steam being taken from a boiler. The bleed duct 27 runs from an intermediate point within the high pressure turbine 2 between two expansion stages therein, and in particular between the third stage and the fourth stage in the example shown. This bleeding is adjusted to a determined pressure P.

In order to perform this adjustment, over a given range D of bleed rates, the exhaust duct 22 from the first turbine 20 is provided with a servo-controlled valve 28. The valve 28 is controlled from a servo-control circuit 29 having means for comparing a reference signal delivered by a set point generator 30 with a signal delivered by a pressure sensor 31 situated in the bleed duct 27.

The installation shown also includes a second, nonadjusted bleed 32 taken downstream from the first stage in the low pressure turbine 21.

In general, the adjustment system 28 is a system including a plurality of valves feeding separate injection sectors.

We claim:

1. In a steam turbine installation provided with means including a bleed line for bleeding the turbine installation to adjust the pressure in the bleed line to a predetermined pressure P, the installation driving a load and including a bleed outlet disposed between two successive stages and opening to said bleed line, the improvement comprising an exhaust duct, and a servo valve disposed on the exhaust duct and controlled by a servo-control circuit including means for measuring the pressure of the bleed flow within said bleed line for adjusting the servo valve disposed on the exhaust duct to adjust the bleed pressure P over a range D of bleed rates.

2. A steam turbine installation according to claim 1, comprising first and second distinct turbines, and wherein said bleed outlet is disposed between two successive stages of the first turbine and said servo valve is disposed on an exhaust duct from said first turbine.

3. A steam turbine installation according to claim 2, wherein said two turbines are cantilever mounted.

* * * * *